United States Patent [19]

Cummings

[11] Patent Number: 4,655,520

[45] Date of Patent: Apr. 7, 1987

[54] ELECTRICAL DISTRIBUTION SYSTEM AND CONNECTOR THEREFOR

[75] Inventor: John H. Cummings, Santa Ana, Calif.

[73] Assignee: Luma Lighting Industries, Inc., Santa Ana, Calif.

[21] Appl. No.: 828,761

[22] Filed: Feb. 11, 1986

[51] Int. Cl.[4] ..... H01R 9/07

[52] U.S. Cl. ..... 339/21 R; 339/22 R

[58] Field of Search ..... 339/20, 21 R, 21 S, 339/22 R, 22 B, 22 T, 23, 24, 97 R, 97 P, 98, 99 R

[56] References Cited

U.S. PATENT DOCUMENTS

| | | | |
|---|---|---|---|
| 1,131,724 | 3/1915 | Mills | 339/99 L |
| 1,287,542 | 12/1918 | Whitney | 339/99 L |
| 2,162,545 | 6/1939 | Benander et al. | 173/340 |
| 2,274,136 | 2/1942 | Frank et al. | 173/334.1 |
| 3,130,921 | 4/1964 | Morgan | 240/8.2 |
| 3,225,185 | 12/1965 | Bertolini et al. | 240/8.2 |
| 3,231,731 | 1/1966 | McDonald | 240/3 |
| 3,248,576 | 4/1966 | Russell | 307/147 |
| 3,321,731 | 5/1967 | Goldbaum | 339/21 |
| 3,341,802 | 9/1967 | Baldwin et al. | 339/21 |
| 3,391,377 | 7/1968 | Corl et al. | 339/21 |
| 3,451,035 | 6/1969 | Baldwin | 339/21 |
| 3,474,381 | 10/1969 | Baldwin | 339/21 |
| 3,489,981 | 1/1970 | Corl et al. | 339/21 |
| 4,099,817 | 7/1978 | Booty | 339/22 B |

FOREIGN PATENT DOCUMENTS

| | | | |
|---|---|---|---|
| 0089223 | 9/1983 | European Pat. Off. | 339/97 R |

*Primary Examiner*—Gil Weidenfeld
*Assistant Examiner*—Gary F. Paumen
*Attorney, Agent, or Firm*—Gausewitz, Carr & Rothenberg

[57] ABSTRACT

An electrical distribution system for lighting and the like including a generally C-shaped channel forming a track having guide shoulders on the exterior of the bight portion thereof, and inwardly extending lip portions adjacent the opening thereof for receiving and captively retaining a multiple conductor insulated cable within the channel. A first channel-shaped connector member is provided with inwardly extending guide portions configured for slidably engaging the shoulders of said channel member, the depth of the first connector member being sufficient for receiving therein a second connector member. The second connector member has a body portion with shoulders thereon spaced a distance less than the distance between adjacent edges of the lips of the open end of the channel member. Conductive barbs extend in generally perpendicular relation to the surface of the body portion intermediate the shoulders thereof, the barbs being at positions corresponding to the position of the conductors to be engaged. A pair of tapered leg portions extend from the body portion at positions for abutting the side walls of the channel member. A sliding coaction between the first and second connector members with the second connector member positioned with the shoulders thereof between the lips of the opening urges the barbs into piercing engagement with the insulation therebeneath for establishing electrical contact between the barbs and the conductors.

40 Claims, 7 Drawing Figures

FIG. 1.
(PRIOR ART)
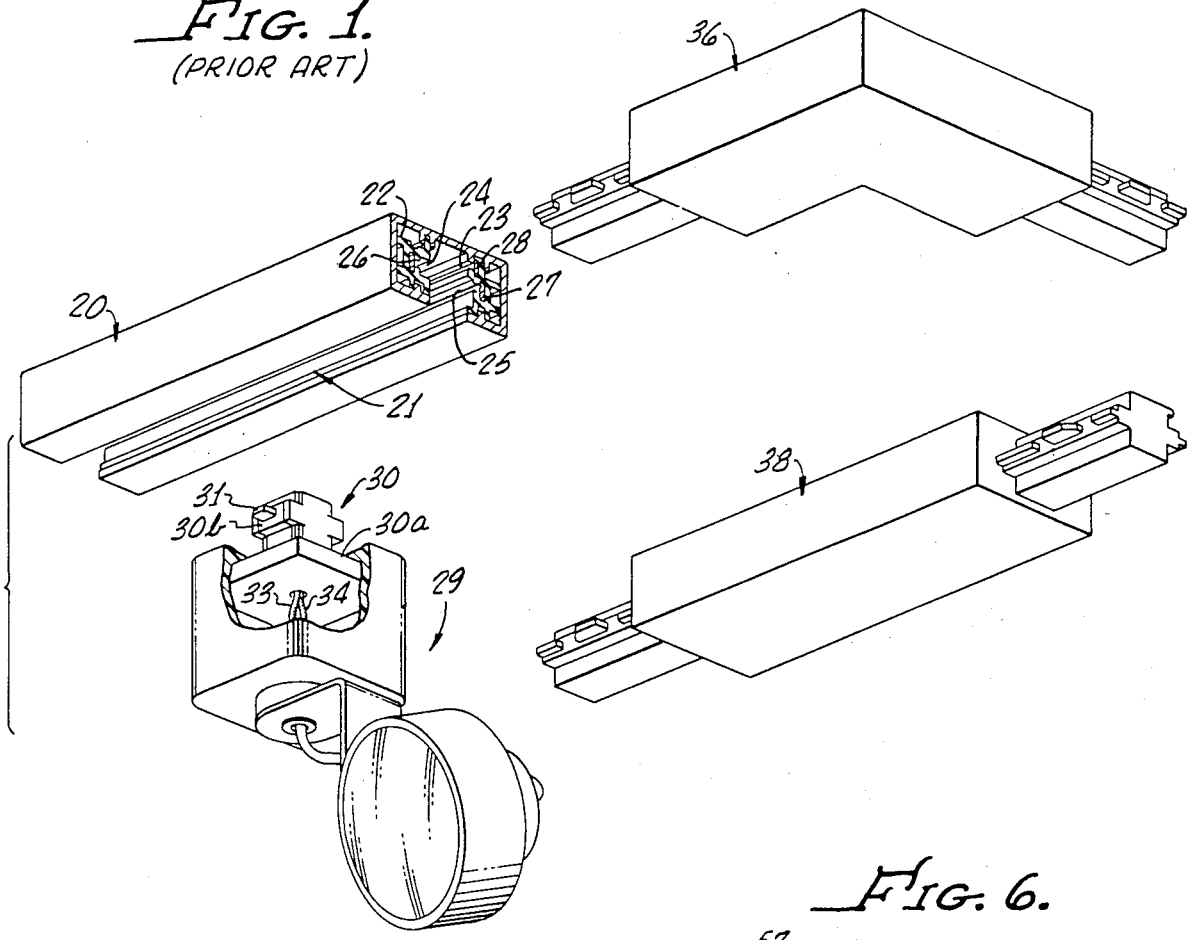
FIG. 6.
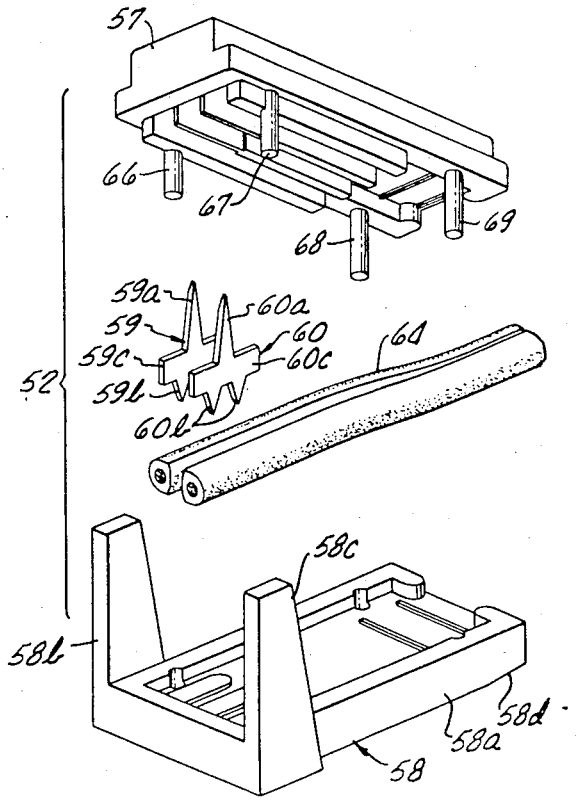
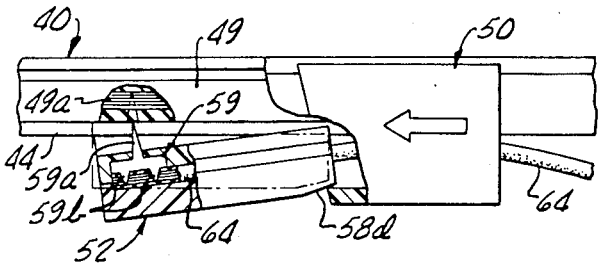
FIG. 7.

ELECTRICAL DISTRIBUTION SYSTEM AND CONNECTOR THEREFOR

BACKGROUND OF THE INVENTION

The background of the invention will be discussed in two parts.

1. Field of the Invention

This invention relates to electrical distribution systems, and more particularly, to a lighting system having lighting fixtures selectively attachable to a track-like conductor assembly, and the connector devices used in such systems.

2. Description of the Prior Art

Electrical distribution systems, and the lighting fixtures used therewith have typically been of a fixed nature. Numerous attempts have been made to provide a measure of flexibility in electrical distribution systems, and particularly with reference to placement of lighting devices. Some of these attempts have utilized specially configured insulated conductor members, positioned or retained in specially configured housings or channels, with plug members or lamp fixture assemblies having prongs or piercing members adapted for penetrating the insulation layer of the conductors upon assembly.

In more recent years, electrical distribution systems for lighting have been developed utilizing a "track" arrangement in which a conductor assembly, enclosed in or formed in a track, enables the placement of any number of a plurality of fixtures at any one of a number of locations along the track. Such systems are referred to as track lighting systems and have the advantage of being able to place illumination where needed, as needed, without complete rewiring behind fixed partitions, walls and ceilings. Such systems have been adopted in commercial, office, manufacturing and retail establishments where flexibility of positioning of lighting sources is important as the need arises for relocation of displays, equipment or walls. In more recent years, such systems have found their way into residential lighting, as functional or decor illumination.

One such early light fixture mounting arrangement is shown and described in U.S. Pat. No. 1,131,724, entitled "Electric Lamp Socket", issued March 6, 1915, to Mills, the socket including a pair of spaced pin members extending from the end thereof opposite the lamp engaging opening, the pins being bent at an angle to the end surface for piercing a two conductor cable at an angle to thus make electrical connection while retaining the socket relative to the cable.

Another mounting arrangement is shown and described in U.S. Pat. No. 1,287,542, entitled "Lamp Mounting" issued to Whitney on December 10, 1918, the mounting including a lamp fixture for attachment to a pair of parallel insulated wire strands. The mounting includes hook shaped edges for engaging the conductors with first and second pin portions adapted for piercing the insulation of each conductor for providing electrical connection thereto.

U.S. Pat. No. 2,162,545, entitled "Electric Fixture", issued June 13, 1939 to Benander et al, the device including an electrical plug arrangement with the housing thereof configured for a dual purpose. One configuration includes blade receiving openings with the receptacle being attachable to a conductor cable for use as an extension, with the second configuration including contact arrangments which enable the same contacts to serve as blades for being received within a plug as well as contacts for the blades of another plug. Electrical connection of a cable to the blade contacts is by means of pins for piercing the insulation layer of the cable.

U.S. Pat. No. 2,274,136, entitled "Continuous Outlet Construction" issued Feb. 24, 1942 to Frank et al, and depicts another arrangement for providing some flexibility to an electrical distribution system. An electrical conductor is formed as a generally C-shaped channel member with electrical conductors or bus bars embedded at the bent portions thereof, with a plug member having a pair of coplanar blades adapted for being received within the open slot portion for engaging the bus bars.

Another lamp mounting arrangement is shown and described in U.S. Pat. No. 3,130,921, entitled "Vehicle Lamp Mounting", issued April 28, 1964 to Morgan. The mounting system includes an electrically conductive channel member attachable to a vehicle with a first channel portion receiving a single conductor strip. A lamp assembly is insertable within the channel member with a first conductor thereof configured and positioned for piercing the insulation of the conductor carried by the strip, with the second conductor of the lamp assembly spring biased for electrically contacting a portion of the channel member.

Another such vehicle lamp mounting arrangement is shown and described in U.S. Pat. No. 3,225,185, entitled "Mounting for Marker Light", issued to Bertolini et al on Dec. 21, 1965. An insulated single conductor is carried within a plastic channel strip inserted into a trough of a structural member. A lamp assembly includes a pointed portion for piercing the conductor to establish a first electrical connection with the ground connection being effected by means of screw members mounting the lamp to the quarter panel.

U.S. Pat. No. 3,231,731, was issued to McDonald on Jan. 25, 1966, and is entitled "Low Voltage Electrical Connector". The patent discloses a system of low volatge outdoor lighting using a two conductor cable with the lamp fixtures provided with a rear surface having portions of the lamp conductors thereon, each conductor portion having a bent corner for forming a prong, with each prong at a position for penetrating the insulation of one of the conductors. Clamping and piercing is effected by a clamp member configured for engaging side walls attached to the fixture for enabling tilting and attachment of the clamp while exerting force to urge the cable against the prongs.

In U.S. Pat. No. 3,248,576, entitled "Electrical Wiring and Conduit Assembly", issued to Russell on Apr. 26, 1966, there is disclosed an electrical distribution system for providing 120 volt and 240 volt power throughout a residence by the use of multiple conductors within a conduit configured as a baseboard, with electrical receptacles attachable thereto.

Another vehicle system is shown and described in U.S. Pat. No. 3,321,732, entitled "Marker Lamp Adapted for Mounting on an automotive Vehicle, and Connection into an Electrical Circuit, Without Use of Tools", which was issued to Goldbaum on May 23, 1967. In accordance with the disclosure, quarter panel of the vehicle is configured with a channel including an electrical conductor with the lamp base configured for engaging a lip formed within the channel, which then enables pivoting of the lamp. A pointed conductive member on the lamp pierces the conductor for establishing the "hot" connection, with ground being effected by a spring member.

U.S. Pat. No. 3,341,802, entitled "Adjustable Mounting for Vehicle Lights", issued September 12, 1967 to Baldwin et al, and discloses another vehicle system employing a channel with a lamp assembly insertable therein with piercing means for providing electrical contact.

U.S. Pat. No. 3,391,377, entitled "Electrical Distribution System", issued July 2, 1968, to Corl et al, and discloses a suspended lighting system using a suspended rigid inverted generally U-shaped conduit with specially constructed conductors therein. A power plug is inserted into the open end and rotated ninety degrees, with prongs for providing electrical connection. A clamp is used to retain the plug on the conduit and to force the prongs through the insulation.

Another vehicle lamp system is shown and described in U.S. Pat. No. 3,451,035, issued to Baldwin on June 17, 1969, such patent being entitled "Rail Mounting Bracket for Vehicle Lamps". The rail is channel shaped with the lamp assembly inserted into the rail by one edge and then pivoted into position, with a coacting pronged connector piercing the insulation of a conductor within the rail.

Another variation of the above Baldwin vehicle lighting system is shown.and described in U.S. Pat. No. 3,474,381, issued Oct. 21, 1969 to Baldwin for "Lamp Connection and Mounting Devices".

U.S. Pat. No. 3,489,981, entitled "Electrical Distribution System", issued Jan. 13, 1970, to Corl et al, and is related to the above-described U.S. Pat. No. 3,391,377 of Corl.

The foregoing prior art is representative of the state of the art in flexible distribution and lighting systems, particularly those employing some form of conductive piercing means in a connection device for penetrating the insulation on an insulated conductor. Such prior art systems, particularly those of the type shown and described by Corl et al, require a rigid metallic generlly fully enclosed conduit with specially constructed conductor arrangements and brackets secured to the conduit with fasteners, such as bolts and the like. Similarly, the prior art of vehicular side lighting does not readily lend itself to residential, commercial and industrial lighting.

SUMMARY OF THE INVENTION

In accordance with the present invention, there is provided an electrical distribution system for lighting and the like including an electrical connection device for use with a standard flexible insulated conductor cable, the device including a generally C-shaped channel having guide shoulders on the exterior of the bight portion thereof, and inwardly extending lip portions adjacent the opening thereof. A flexible insulated conductor cable is received within the channel and captively retained therein by the lip portions. A first channel shaped connector member is provided with inwardly extending guide lip portions configured for slidably engaging the shoulders of the channel member, the depth of the first connector member being sufficient for receiving therein a second connector member. The second connector member has a body portion with shoulders thereon spaced a distance less than the distance between adjacent edges of the lips of the open end of the channel member. Conductive barbs extend in generally perpendicular relation to the surface of the body portion intermediate the shoulders thereof, the barbs being at positions corresponding to the position of the conductors to be engaged. A pair of leg portions extend from the body portion at positions for abutting the side walls of the channel member. A sliding coaction between the first and second connector members, with the second connector member positioned with the shoulders thereof between the lips of the opening, urges the barbs into piercing engagement with the insulation therebeneath for establishing electrical contact between the barbs and the conductors. A cam surface on the second connector member at the edge of initial contact with the first connector member facilitates application of pressure to the barbs for penetration of insulation of the conductors.

Other features and advantages of the invention will become apparent from a reading of the specification, when taken in conjunction with the drawings, in which like reference numerals refer to like elements in the several views.

BRIEF DESCRIPTION OF THE DRAWINGS

FIG. 1 is an exploded perspective view, partially in cross-section and partially broken away, of a prior art track lighting system;

FIG. 6 is an exploded perspective view of a connector member used in the lighting system of FIG. 2; and FIG. 7 is a side elevational view, partially broken away and partially in cross-section of the connection of the system of FIG. 2.

DESCRIPTION OF THE PREFERRED EMBODIMENT

Figure 2:
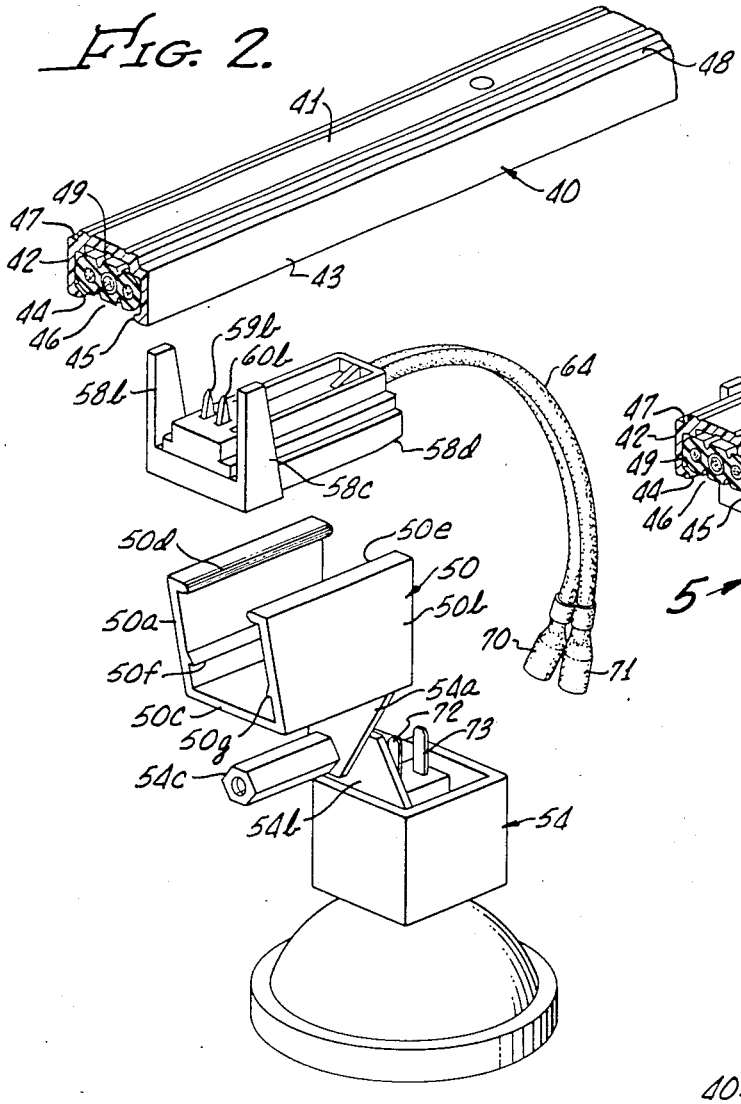
FIG. 2 is an exploded perspective view of an electrical distribution system and connector according to the invention.
Figure 4:
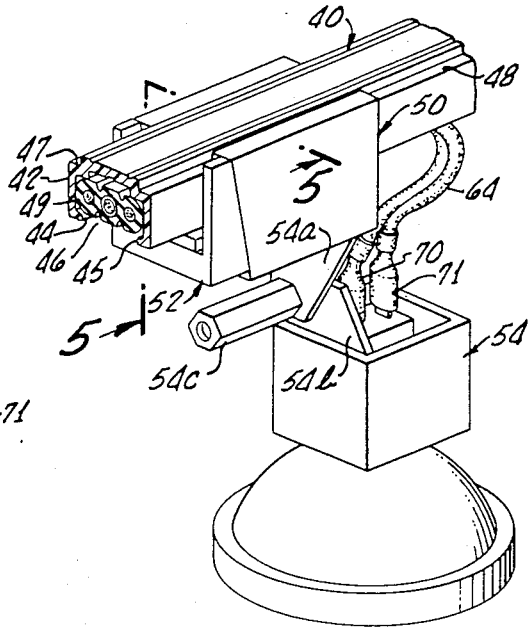
FIG. 4 is a perspective view of the electrical distribution system of FIG. 2, in assembled relation.

Referring now to the drawings, and particularly to FIG. 1, there is shown a representative prior art track lighting system, in which an extruded metallic channel 20 is provided, the channel 20 having a slotted opening 21 along the length thereof. On the interior of channel 20 appropriate rib means are configured as part of the extrusion for receiving therein a pair of channel-shaped, preferably extruded, opposing insulated carrier members 22 and 23, which are inserted therein. Each of the carrier members 22, 23, is provided with longitudinally extending furrows 24 and 25, respectively, formed therein in opposing aligned relation, with slotted openings for enabling insertion of non-insulated, solid bus bars or conductors 26 and 27 of rectangular cross-section, with the surfaces thereof in opposing, aligned, generally parallel relation. In the right carrier 23, an additional furrow and bus bar 28 is added thereto, upwardly offset from the lower bus bar 27.

A light fixture, such as fixture 29 may be attached for support by the channel 20 by means of an adaptor 30, which has a lower end **30*a* of a generally square configuration slightly greater than the width of the channel member 20, and an upper end 30*b* of a smaller plate-like configuration, the shorter dimension of which is slightly less than the width of the opening of slot 21 of the channel member 20 for passage therethrough. The adaptor 30 has formed therein or secured thereto, first and second opposed conductor blades 31 (only one of which is shown) in general alignment with the longer dimension of the upper plate-shaped end 30*b* of adaptor 30. The conductor blades 31 are connected to electrical leads 33 and 34, respectively, for connection to the socket of the fixture 29** in a conventional manner.

The fixture 29 is attached by insertion of the upper plate-shaped end **30*b* of adaptor 30 into the channel opening 21, with rotation through ninety degrees causing the longer dimension thereof to enter the furrows 24 and 25, above the upper surfaces of the inwardly extending edges of the channel member 20. Upon rotation, the blade members 31 will pass through the opposing furrows 24 and 25 of the insulated carrier members 22 and 23 into frictional electrical engagement with the bare conductors 25 and 26. A third grade, not shown, may be located on the end 30*b* of the adaptor 30 for electrical contact with the bus bar 28**.

With such systems, each channel member 20 and each of the carrier members 22 and 23, along with the conductors 26 and 27, is formed as a unit of a given length. To achieve greater lengths, units are placed.in endwise abutting relation, or in perpendicular relation. In either event, a special interconnection device, such as corner device 36, or straight connect device 38, is required. Each of these interconnection devices is constructed to include opposing ends insertable into the open end of the channel member 20 with opposing pairs of aligned blade members on each end adapted to frictionally engage the bare conductors 26 and 27. Within the body of each of the devices 36 and 38, there are internally connected wires or conductors which electrically interconnect the aligned blades on each side of the device 36 or 38.

Such prior art systems are expensive to construct, are unduly complicated, and require specially constructed components, such as the channel 22 with internally formed ribs and the specially configured carrier members 22 and 23. Such configurations generally require expensive extrusion dies. Furthermore, assembly is expensive with the insertion of the bus bars 26 and 27 into the carriers 22 and 23, whether performed manually or automatically. In addition, such systems provide limited flexibility of placement of the channels due to the requirement for different interconnect devices 36 and 38 for different purposes.

With such prior art systems, when repositioning of a fixture 29 is desired, an additional complication is encountered. With the adaptor of the prior art, the entire fixture 29 and adaptor 30 must be physically separated from the channel member 20. With the channel member attached to a fixed surface such as a ceiling, a ladder is normally employed for attachment and removal, as a consequence of which the fixture 29, its lamp, and the adaptor 30 have to be carried by the worker down the ladder, moved to the next location along with the ladder, and carried back up the ladder for relocation. With one hand of the worker carrying rather obtrusive devices, only one hand is free to grip the ladder, thus creating a potential safety problem.

In accordance with the instant invention, as will hereafter be described, there is shown an electrical distribution system in the form of a track lighting system, which is economical to fabricate, is simple to install, requires no special track section interconnect devices, and enables suspension and sliding of a fixture along the track during relocation, thus eliminating a part of the cumbersome method of the prior art.

Referring now to FIGS. 2 through 5, there is shown a track lighting system according to the invention, wherein a channel member 40, formed of as somewhat resilient plastic material, such as by extrusion, has a bight portion 41, first and second generally parallel opposing sidewalls 42, and 43 extending from the bight portion 41, and aligned inwardly extending generally coplanar lip portions 44, 45 defining a longitudinally extending slot or opening 46. At the junction of the sidewalls 42, 43 to the bight portion 41, inwardly stepped guide means are formed in the shape of shoulders 47, 48. The channel member 40 is configured for attachment to a surface, such as a ceiling, by positioning the bight portion 41 against the surface and inserting suitable fastening means, such as screws, through the bight portion into the ceiling.

Figure 3:
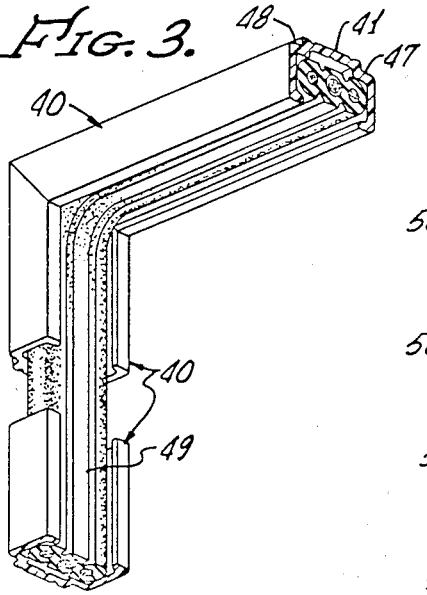
FIG. 3 is a perspective view of the track of the electrical distribution system of FIG. 2 angularly positioned.

The elongate slot or opening 46 of channel member 40 is dimensioned and configured for receiving therein an insulated cable 49, which is a multiple conductor cable having multiple strand interleaved conductors therein. The cable 49 may be slidably inserted into an end of the channel 40, or alternatively it may be simply pressed, or snapped through the slot 46. In practice, as will be hereafter discussed, the cable 49 may have two conductors lying side by side within the channel member 40, or may have three side by side conductors, the only requirement being that all conductors have the centers thereof within the dimension between the lip portions 44 and 45 for piercing engagement and electrical contact by the barb means to be described hereinafter. The dimension of the channel member 40 and cable 49 is such that the width of the cable 49 is approximately the same dimension as the distance between the interiors of the sidewalls 42, 43, with the overlying lip portions 44, 45, generally restraining the cable 49 from movement out of the opening 46. However, the cable 49 may be a snug fit within the channel member 40 to restrain all unwanted relative motion of the cable 49 within the channel member 40. Alternatively, a cable 49 of lesser width may be inserted into the channle member 40 along with a spacer of flexible material. As shown in FIG. 3, with the channel member 40 suitably mitered, adjacent sections may be butted together at the miter thereof and the cable 49 bent at right angles for enabling angular orietation of adjacent sections without the use of specially configured coupling devices. Furthermore, the cable 49 need not be specially constructed, and may be commercially available cable. In addition, the channel member 40, even in a straight run, may be made of a number of sections, each shorter than the total length of a channel member 40 with the ends of the shorter adjacent sections either butted together or spaced from one another. In the latter case, the continuous cable 49 bridges the gap between adjacent channel sections.

For connection to the channel member 40, a first connector member 50 and a second mating connector member, generally designated 52 are provided, with member 50 configured for securing to a suitable light fixture, generally designated 54. In brief, the connector member 52 is adapted for electrical connection with the cable 49, connector member 50 is adapted for securing to a fixture 54, and connector members 50 and 52 are configured for interconnecting to both urge the connector 52 into good electrical engagement, and to secure the fixture 54 in position relative to the channel member 40. The fixture 54 is assembled to the connector 50 by means of an L-shaped bracket 54*a* having a leg thereof pivotally mounted to the bight portion 50*c* of the connector 50. The other leg of bracket 54*a* has an aperture therethrough for pivotal coupling to a brace 54*b* of the fixture 54 by suitable fastening means, such as elongate nut 54*c* manually threadable on a screw member (not shown).

The connector member 50 is generally channel-shaped, with generally parallel sidewalls 50*a* and 50*b*, an interconnecting end wall 50*c*, and inwardly extending edges 50*d* and 50*e* at the free ends of the sidewalls 50*a* and 50*b*. One edge of each of the sidewalls 50*a* and 50*b* is generally perpendicular to the plane of the edges, while the other opposing edges of the sidewalls are tapered. The dimension between sidewalls 50*a* and 50*b* is generally equal to the width of the channel member 40, with the edges 50*d* and 50*e* dimensioned for engagement with the shoulders 47 and 48 of channel member 40. The depth of the connector member 50 is sufficient for engaging the channel member 40 along with the connector member 52. The connector member 50 includes, on the interior of the sidewalls 50*a* and 50*b* thereof, a pair of aligned inwardly extending ribs 50*f* and 50*g* positioned for coaction with a surface of the generally block-shaped portion of connector member 52 as will be hereafter described. Each of the connector members 50 and 52 is preferably made of a plastic material which is generally rigid, with a slight flexibility.

As shown in FIG. 6, the connector member 52 is formed of first and second members, 57 and 58, and first and second barb members 59 and 60. The member 57 is generally block-shaped with stepped edges and is provided, adjacent one end thereof, with three rectangularly configured slots 61, 62 and 63, (See FIG. 5) and has portions thereof suitably configured to form guideways in alignment with the slots 61–63 for matingly receiving therein the separated conductors of a two conductor cable 64. With the cable 64 resting in the guideways, one end of the cable 64 terminates above two of the slots 61–63. The barb members 59 and 60 are identically configured, with each being formed of a suitable conductive metallic material, such as brass. Each barb member is generally flat with first and second opposing barbs 59*a* and 59*b* and an intermediate flange portion 59*c*. Barb 59*a* is longer than barb 59*b* and is inserted through the center slot 62 of the slots 61–63, with the longer barb 60*a* (which is longer than barb 60*b*) inserted through another one of the remaining slots 62, 63. The flange portions 59*c* and 60*c* rest in recesses (not shown) formed on the interior of member 57 adjacent the end of the guideways. In this position, the smaller barbs 59*b* and 60*b* are in alignment with the end of the insulated cable for piercing of the two conductors thereof. The cable 64 is preferaby formed with each conductor consisting of multiple strands of electrical wire, and the free end of the cable 64 need not have the insulation removed.

The member 57 is provided adjacent the corners thereof with four integrally formed projections 66–69 for insertion through aligned apertures in the member 58, which has a plate-shaped body portion 58*a* adapted for being secured to the other member 57 with the end of cable 64 urged into piercing engagement with the smaller barbs 59*b* and 60*b*. The other end of cable 64 may be electrically attached to the fixture 54 by any suitable means, such as, for example, terminal pin female connections 70 and 71, which may be removably attached to terminal pins 72 and 73 on the fixture 54.

A pair of tapered leg portions 58*b* and 58*c* adjacent one edge of the body portion 58*a* of member 58 extend in a direction perpendicular to the plane thereof and lie outside the width of the main body portion 58*a*. The angle of taper of the leg portions 58*b* and 58*c* coincides with the angle of taper of the tapered edges of the sidewalls 50*a* and 50*b* of connector 50 for coaction therewith to serve as a stop means during interconnection. Similarly, the spacing between the leg portions 58*b* and 58*c* is generally identical to the spacing between the sidewalls 50*a* and 50*b* of connector 50, and the length of the leg portions 58*b* and 58*c* coincides with the adjacent length of the sidewalls 50*a* and 50*b*. For reasons which will hereafter become apparent, the leading edge of the body portion 58*a* is provided with cam means in the form of a chamfer 58*d* on the lower surface thereof (as viewed in FIGS. 6 and 7), this lower edge being the initial point of engagement of the connectors 50 and 52 during interconnection.

The second connector member 52 is assembled by placing the barb members 59 and 60 into the adjacent slots, such as slots 61 and 62 of member 57. One end of the two conductor cable 64 is positioned over the two barb members 59 and 60, and gently urged downwardly until the barb ends 59*b* and 60*b* penetrate the adjacent layer of insulation of the cable 64. The member 58 is then positioned over the member 57 with the leg portions 58*b* and 58*c* straddling the main body portion 57*a*, and the parts are pressed into coaction with the projections 66–69 of member 57 passing into engagement with the aligned apertures of member 58, whereupon the parts are suitably bonded, such as by adhesive or plastic bonding techniques. As assembled the connector member 52 is low profile, of compact size, and includes a "pigtail" electrical connection attached thereto in the form of the cable 64 with its connector ends 70 and 71.

Referring now to FIGS. 2, 4, 5 and 7, the first and second connector members 50 and 52 are interconnected to the channel member 40 in the following manner. The connector member 50 is placed over the channel 40, with sides 50*a*, 50*b* engaging the exterior surface of the sidewalls 42, 43 of the channel member 40, and with the lips 50*d* and 50*e* thereof slidably engaging the shoulders 47 and 48, respectively, of the channel member 40. The connector member 50, being formed of a plastic material, has the capability of slight separation of the sidewalls 50*a* and 50*b* as needed for enabling placement of the member 50 adjacent a desired location for the fixture 54 attached thereto. The proximity of the wall or ceiling surface adjacent the bight portion 41 of the channel member 40 serves to prevent cocking or pivoting of the connector member 50 with the fixture 54 attached thereto. Alternatively, the connector member 50 may be attached to the channel member 40 by sliding the connector member 50 over the channel member 40 from the end of the latter.

The connector member 52 is then positioned at the desired location and, as shown in FIGS. 2 and 7, is urged upwardly, with the leg portions 58*b* and 58*c* straddling and slidably contacting the channel member 40, and serving as self-centering guides for positioning of the barbs 59*a* and 60*a* relative to two of the conductors within the three conductor cable 49. During this upward movement a slight amount of pressure provides slight penetration of the barbs 59*a* and 60*a* into the insulation of the cable 49. At this point, as viewed in FIG. 7, the first connector member 50 will be positioned to the right of the connector member 52, being slidably attached to the channel member 40, and with the tapered edges of the sidewalls 50*a* and 50*b* in position for abutting engagement with the taper of the tapered leg positions 58*b* and 58*c*, respectively. The connector member 50 will then be moved to the left slidably along the channel member 40, whereupon the cammed edge or chamfer 58*d* of the main body portion 58*a* of the connector member 52 is engaged initially. The edge chamfer 58*d* of the connector member 52 provides a cam surface to be engaged by the inner surface of the leading edge of end wall 50*c* of connector member 50 as the latter slides along the track and slides into engagement with connector member 52. As the connector member 50 is advanced to the left, the main body portion 58*a* of the connector member 52 will have the stepped edge thereof (See FIG. 5) engaged between the ribs 50*f* and 50*g* of the interior walls of the connector member 50 for sliding relative thereto. As the member 50 is further moved toward connector 52, the sliding and camming engagement pivots the left end of the connector member 52 upwardly, thus urging the barb members 59*b* and 60*b* and the entire connector member 52 upwardly (as viewed in FIG. 7) to further penetrate the insulation of the cable 49 until the parts are in the position depicted in FIG. 4, with the tapered edges in abutting relation. During this relative movement of the two connectors 50 and 52, the resilience of the insulation of the cable 49 urges against the penetration, thus assisting in maintaining the connector member 52 in the desired position. At this position, the two connectors 50 and 52 are in interlocked relation, whereupon the terminal connections 70 and 71 of the two conductor cable 64 may be attached to the pins 72 and 73 of the fixture 54.

Figure 5:
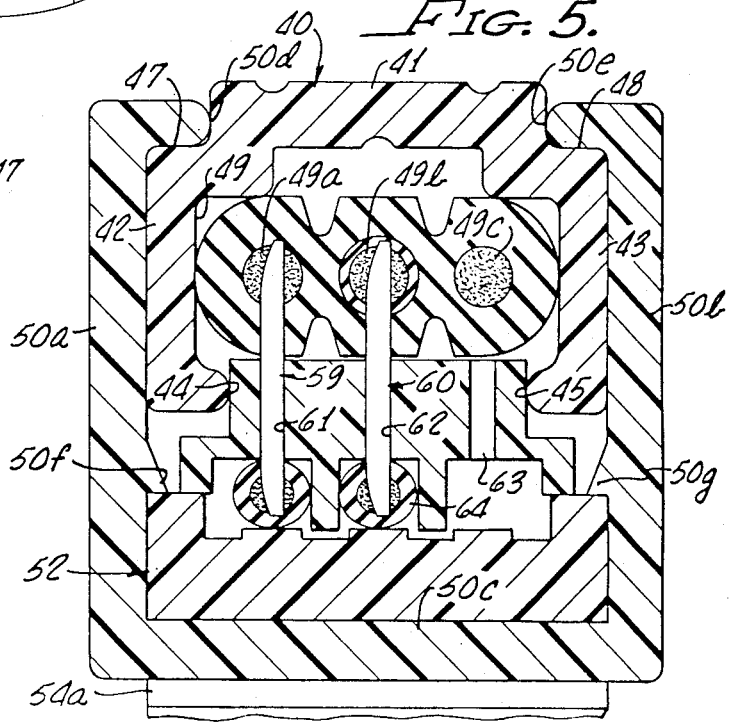
FIG. 5 is a cross-sectional view of the assembled system of FIG. 4, as viewed generally along line 5—5 thereof.

By use of the ribs 50*f* and 50*g* of the connector member 50, and the sliding coaction of connector member 52 therewith, as depicted in FIG. 5, the depth of insertion of the barbs 59*b* and 60*b* into the cable 49 is limited, and essentially controlled by the relative dimensions of the interconnected parts. Although the ribs 50*f* and 50*g* are not absolutely necessary to limit the depth of insertion, they serve as guides during the interconnection of the two connector members and assist in the camming action by imposing a restraint during sliding engagement. In this manner, depressions are avoided on the cable 49 at those locations previously engaged by the connector 52. As the tapered edges of the sidewalls 50*a* and 50*b* contact the tapered legs 58*b* and 58*c*, the legs 58*b* and 58*c* serve as a stop means for limiting the relative movement of the interconnected connectors. If deemed necessary or desirable, frictional or resilient latching means, such as a detent and recess (not shown) may be formed on or attached to the respective connector members 50, 52, to maintain them in the engaged relationship shown in FIG. 4.

In accordance with the present invention, the connector member 52, as shown in FIG. 5, has the barbs 59*b* and 60*b* thereof penetrating the insulation for electrical contact with conductors 49*a* and 49*b* of the cable 49. The connector member 52, with the barbs 59*a* and 60*a* as shown may be rotated 180 degrees, in which event the barbs 59*b* and 60*b* will engage the center conductor 49*b* and the other conductor 49*c*. Alternatively, the connector member 52 may have the two barbs thereof positioned for passage through slots 62 and 63 for engagement with conductors 49*b* and 49*c*, with the connector member 52 oriented as shown.

This flexibility of the connector member 52 is adapted for use in systems, such as low voltage systems, utilizing a center-tapped transformer, in which the center conductor 49*b* is neutral or ground and is attached to the center tap of the transformer, and the two outer connectors 49*a* and 49*c* are coupled to opposite ends of the windings. In such event the voltage from the center conductor 49*b* to either of the outer conductors is the same, with the voltage between the two outer conductors 49*a* and 49*c* being twice that voltage. With the slot arrangement of the connector member 52 the barbs 59*b* and 60*b* may be selectively positioned for either high or low voltage, or low voltage on either bus system, thus enabling proper power distribution with one cable 49.

As previously discussed, when it is desired to change the location of a fixture 54, the connector member 50 along with fixture 54 may be slidably uncoupled from connector member 52, and retained on the channel member 40. The smaller connector member 52 may then be detached from the cable 49 (with fixture cable 64 loosely extending through connector member 50) and, the now partly disassembled connector parts can be slidably moved along the track for repositioning of the lamp fixture 54. At a new location, connector member 52 is reattached to the cable 49 and the connector member 50 is slidably moved along the channel member 40 for coupling the connector member 52 to the cable at the new location. Thus the connector member 50 need not be detached from the channel 40 for fixture 54 relocation.

With the plastic composition of the channel member 40, the cable 49 may conveniently be snapped into place by manually applying pressure. Thus the channel members 40 may be assembled with both straight sections and mitered corner sections of channel member 40 cut to length as desired, and installed or affixed to a supporting surface. After positioning of the track or channel 40 sections, the cable 49 may then be inserted. In addition, with the two part connector arrangement, the connector 50 serves a dual function of retaining thereon the lamp fixture 54, while serving to hold and lock into place the other connector member 52. Similarly, the connector member 52 serves a dual function of making contact with the conductors of the cable 49 while preventing the fixture 54 from movement upon interlocking engagement with connector member 50. Although not important to an understanding of the invention, the attachment of fixture 54 to connector member 50 may take any convenient form such as shown in the drawings. With the fixture 54 thus mounted, it is pivotable in two different directions to provide the same positioning capability as a ball and socket arrangement for enabling manual aiming of the light therefrom once attached to the track or channel 40. Additionally, it is to be understood that any suitable electrical fixture may be attached to the connector member 50, such as an electrical outlet receptacle, if desired, and the term fixture as used herein is deemed to include such other devices.

Although lengths of the channel member 40 are shown to be continuous with the length of the cable corresponding to that length, it will be appreciated that the length of the channel member 40 may be slightly larger than the length of the interlocked connectors. Thus the track may be made of a number of shorter mutually spaced sections, with each such section individually mounted at a point along the selected path of the cable 49. After mounting the channel member sections, the continuous length of cable 49 is laid out along the path defined by the spaced channel member sections. Then a connector member 50 for each section, each with its attached fixture, is slid over the channel member section to engage and secure a connector 52 so as to make the desired electrical connection. Furthermore, although the description has proceeded with reference to a cable 49 having a dimension approximating the dimension of the interior width between the sidewalls 42 and 43 of channel 40, a conductor cable of lesser width, and fewer than three conductors, may be conveniently employed with a suitable spacer of flexible material interposed between a sidewall and an edge thereof for alignment of the two conductors with the appropriate barb means.

While there has been shown and described a preferred embodiment, it is to be understood that various other adaptations and modifications may be made within the spirit and scope of the invention.

I claim:

1. A lighting system comprising:

a channel member having guide means and a generally C-shaped cross-section with an opening;

a flexible cable having a plurality of insulated conductors therein, said cable being retained within said channel member;

a first connector member having means thereon for slidably engaging said guide means and other means for attachment to an electrical fixture;

a second connector member having barb means for piercing the insulation of at least some of said conductors of said cable through the opening of said channel member, and electrical connection means for connection to the electrical fixture, said first and second connector members being configured for coacting engagement for urging said barb means through the insulation of said at least some of said conductors and for retaining said connector members in fixed relation relative to said channel member, and interengaging cam means on said first and second connector members for driving said second connector member toward said channel member and said cable in response to sliding motion of said first connector member along the length of said channel member.

2. The combination according to claim 1 wherein said first connector member is slidably mounted on the exterior of said channel member for engaging said guide means, and including means on said second connector member for preventing slidable motion of said first connector member.

3. The combination according to claim 2 wherein said means for preventing slidable motion of said first connector member includes, at least in part, said barb means.

4. The combination according to claim 1 wherein said channel member includes a bight portion and said guide means include a pair of shoulder means on the bight portion of said channel member.

5. The combination according to claim 4 wherein said first connector member is generally C-shaped and includes edge portions for coacting with said shoulder means.

6. The combination according to claim 1 wherein said electrical fixture is a light fixture pivotally attached to said first connector member.

7. The combination according to claim 6 wherein said electrical connection means on said second connector member includes electrical lead means and said light fixture includes terminal means for removably connecting said lead means.

8. The combination according to claim 1 wherein said second connector member includes leg means positioned for abutting relation with the sides of said channel member, said leg means limiting relative sliding movement between said first and second connector members.

9. The combination according to claim 8 wherein said first and second connector members include coacting means for limiting insertion of said barb means into said cable.

10. The combination according to claim 9 wherein leg means includes a pair of generally parallel tapered leg portions.

11. The combination according to claim 10 wherein said second connector member has a generally block-shaped body portion, and said first connector member is configured for slidably receiving said body portion therein.

12. The combination according to claim 11 wherein said first connector member is generally C-shaped and the side walls thereof are generally tapered for edgewise coaction with said tapered leg portions of said second connector member.

13. An electrical distribution system comprising:

an elongate channel member having guide means and a generally C-shaped cross-section with an opening extending the length thereof;

a flexible cable having three insulated conductors therein, said cable being dimensioned for being retained within said channel member;

a first connector member having means thereon for slidably engaging said guide means and means for attachment to an electrical fixture;

a second connector member configured for being positioned on said channel member at said opening and having barb means for piercing the insulation of two of said conductors of said cable in a first orientation and one of said two conductors and another of said conductors in an opposite orientation;

means on said second connector member for providing electrical connection between said barb means and an electrical fixture, said first and second connector members being configured for coacting engagement for urging said barb means through the insulation of said conductors and for retaining said connector members in fixed relation relative to said channel member, and interchanging cam means on said first and second connector members for driving said second connector member toward said channel member and said cable in response to sliding motion of said first connector member along the length of said channel member.

14. The combination according to claim 13 wherein said first connector member is slidably mounted on the exterior of said channel member for engaging said guide means, and including means on said second connector member for preventing slidable motion of said first connector member.

15. The combination according to claim 14 wherein said first and second connector members are coactingly configured for limiting the depth of insertion of said barb means into said conductors.

16. The combination according to claim 14 wherein said channel member includes a bight portion and said guide means include a pair of shoulder means on the bight portion of said channel member.

17. The combination according to claim 16 wherein said first connector member is generally C-shaped and includes lip portions for coacting with said shoulder portions.

18. The combination according to claim 14 wherein said system includes a light fixture pivotally attached to said first connector member.

19. The combination according to claim 18 wherein said electrical connection means on said second connector member includes electrical lead means and said light fixture includes terminal means for removably connecting said lead means.

20. The combination according to claim 14 wherein said second connector member includes leg means positioned for abutting relation with the sides of said channel member.

21. The combination according to claim 20 wherein said first and second connector members include coacting means for limiting insertion of said barb means into said cable.

22. The combination according to claim 21 wherein said leg means includes generally parallel tapered leg portions.

23. The combination according to claim 13 wherein said second connector member has a generally block-shaped body portion and said first connector member is configured for slidably receiving said body portion of said second connector member therein.

24. The combination according to claim 23 wherein said second connector member includes leg means positioned for abutting relation with the sides of said channel member, and said first connector member is generally C-shaped and the side walls thereof coact with said leg means of said second connector member to limit relative motion between said first and second connector members.

25. The combinatron according to claim 13 wherein said channel member is formed of a resilient material and has a pair of inwardly extending lip portions, and wherein said cable is a tight snap fit between said lip portions within said channel member.

26. In an electrical distribution system, the combination comprising:

a flexible cable having at least two insulated conductors therein;

a channel member configured for receiving said cable therein, said channel member having guide means thereon;

one connector member having at least two barb means configured and positioned for passing through an opening of said channel member for piercingly engaging said at least two conductors;

another connector member having means for coacting with said guide means and being configured for slidable movement relative to said one connector member and along said guide means in the longitudinal direction for urging said barb means through the insulation of said at least two conductors and for retaining said one connector member in engagement with said channel member;

electrical fixture means coupled to said another connector member; and means for electrically interconnecting said barb means and said electrical fixture means.

27. The combination according to claim 26 including interengaging cam means on said one connector member and said another second connector member for driving said one connector member toward said channel member and said cable in response to sliding motion of said another connector member along said channel member.

28. Tne combination according to claim 26 wherein said another connector member is slidably mounted on the exterior of said channel member for engaging said guide means, and including means on said one connector member for limiting slidable motion of said another connector member relative thereto.

29. The combination according to claim 26 wherein said one connector member has a generally block-shaped main body portion, and said another connector member is generally channel-shaped and includes rib means therein for coaction with said main body portion.

30. The combination according to claim 29 wherein the coaction of said main body portion with said rib means limits the depth of penetration of said barb means into said conductors.

31. The combination according to claim 26 wherein said one connector member has a body portion formed of first and second parts secured together, said first part having slot means therein for receiving said barb means, said barb means including first and second aligned opposing barb portions, with said first barb portions extending through said slot means for piercing said conductors, the space between said first and second parts being configured for receiving another insulated cable therein for piercing by said second barb portions with the securing of said first and second parts together retaining said another insulated cable therein.

32. The combination according to claim 26 wherein said one connector member and said another connector member include cam means for assisting in urging said barb means into penetrating engagement with said conductors and stop means for limiting relative slidable movement between said one and said another connector members.

33. The combination according to claim 32 wherein said another connector member is attached to said channel member for slidable motion along said channel member for movement between a locking position in which the one connector member is fixedly held with its barb means extending through said insulation, and a second position in which the connector members are disengaged from each other to allow the one connector member to be detached from the cable and channel member, said another connector member in said second position still being slidably coupled to said channel member whereby said one connector member may be detached from at attached to said cable and selected locations along said channel member without detaching said another connector member from its slidable attachment to the channel member.

34. The combination according to claim 26 wherein said channel member is formed of a generally rigid somewhat flexible material for enabling insertion of said cable therein by application of pressure.

35. The combination according to claim 26 wherein said another connector member is formed as a channel-shaped plastic member.

36. The combination according to claim 25 wherein said guide means include shoulder means adjacent the bight portion of said channel member and said another connector member has lip means for slidably engaging said shoulder means.

37. An electrical distribution system comprising:

a plurality of track sections;

a flexible cable position within said track sections;

a first connector having barb means for penetrating said cable;

a second connector slidably mounted on one of said track sections adjacent said first connector for motion along the track section between a first position displaced from the first connector and at which first position the first connector may be detached from said cable, and a second position in contact with said first connector;

interengaging means on said first and second connectors responsive to slidable motion of the second connector along the track section relative to the first connector for urging the barb means toward engagement with the cable; and means on said second connector for holding said first connector in position adjacent said track section with said barb means contacting said cable, whereby said first connector may be detached from said track section by slidably moving said second connector along the track section to said first position and whereby said first connector may be electrically and mechanically connected to said cable and track section by sliding said second connector from said first position to said second position.

38. The combination according to claim 37 further including an electrical fixture attached to said second connector and means for electrically coupling said fixture and said barb means.

39. The combination according to claim 37 wherein said interengaging means on said first and second connectors includes cam means for driving said first connector member toward said channel member and said cable in response to sliding motion of said second connector member along said channel member.

40. The combination according to claim 37 wherein said second connector member is slidably mounted on the exterior of said channel member for engaging said guide means, and including means on said second connector member for limiting slidable motion of said first connector member relative thereto.

* * * * *